US006799429B2

(12) United States Patent
Drube et al.

(10) Patent No.: US 6,799,429 B2
(45) Date of Patent: Oct. 5, 2004

(54) HIGH FLOW PRESSURIZED CRYOGENIC FLUID DISPENSING SYSTEM

(75) Inventors: Paul Drube, Burnsville, MN (US); Timothy Neeser, Burnsville, MN (US); Thomas Shaw, Montgomery, MN (US); David Wondra, Montgomery, MN (US)

(73) Assignee: Chart Inc., Burnsville, MN (US)

( * ) Notice: Subject to any disclaimer, the term of this patent is extended or adjusted under 35 U.S.C. 154(b) by 0 days.

(21) Appl. No.: 10/306,624

(22) Filed: Nov. 27, 2002

(65) Prior Publication Data

US 2003/0126867 A1 Jul. 10, 2003

Related U.S. Application Data

(60) Provisional application No. 60/334,192, filed on Nov. 29, 2001.

(51) Int. Cl.[7] ..... F17C 9/02
(52) U.S. Cl. ..... 62/50.2
(58) Field of Search ..... 42/45.1, 50.1, 42/50.2, 50.4

(56) References Cited

U.S. PATENT DOCUMENTS

| | | | | |
|---|---|---|---|---|
| 2,576,985 A | | 12/1951 | Wildhack | |
| 3,091,096 A | | 5/1963 | Rendos et al. | |
| 4,174,619 A | | 11/1979 | Tocha | |
| 4,343,156 A | | 8/1982 | Gauthier | |
| 4,838,034 A | * | 6/1989 | Leonard et al. | 62/50.2 |
| 5,390,500 A | | 2/1995 | White et al. | |
| 5,458,188 A | * | 10/1995 | Roehrich et al. | 165/64 |
| 5,467,603 A | | 11/1995 | Lehman et al. | |
| 5,687,776 A | | 11/1997 | Forgash et al. | |
| 5,771,946 A | | 6/1998 | Kooy et al. | |
| 5,924,291 A | * | 7/1999 | Weiler et al. | 62/50.2 |
| 5,937,655 A | * | 8/1999 | Weiler et al. | 62/50.1 |
| 6,044,647 A | | 4/2000 | Drube et al. | |
| 6,276,143 B1 | | 8/2001 | Wimberley | |

* cited by examiner

*Primary Examiner*—Cheryl J. Tyler
*Assistant Examiner*—Malik N. Drake
(74) *Attorney, Agent, or Firm*—Piper Rudnick LLP

(57) ABSTRACT

A high pressure cryogenic fluid dispensing system features a tank containing a cryogenic liquid with a liquid side and a head space there above. A pressure building coil featuring a section of parallel heat exchangers and a section of series heat exchangers receives liquid from the tank through a pressure building regulator valve and a pair of surge check valves. The liquid flashes to gas in the section of parallel heat exchangers and the resulting gas is forced to the section of series heat exchangers where it is pressurized and warmed. The gas may be directed to a warming coil for dispensing and to the head space of the tank to rapidly pressurize it. Gas traveling to the head space flows through an vapor space withdrawal control valve. The vapor space withdrawal control valve and pressure building regulator valve may be automated via a controller that provides pressure building when the tank pressure drops below the system operating pressure.

20 Claims, 8 Drawing Sheets

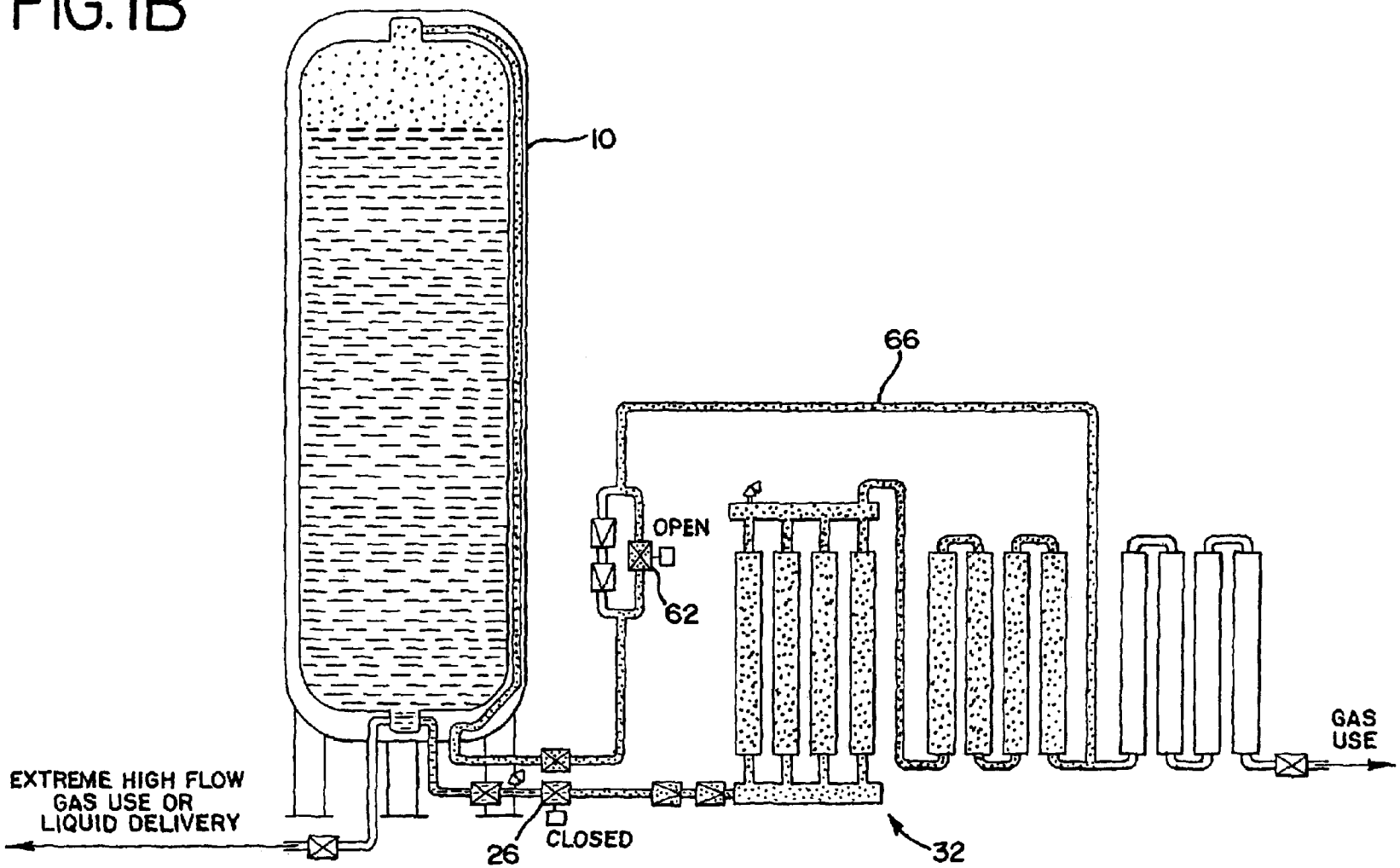
FIG. IB

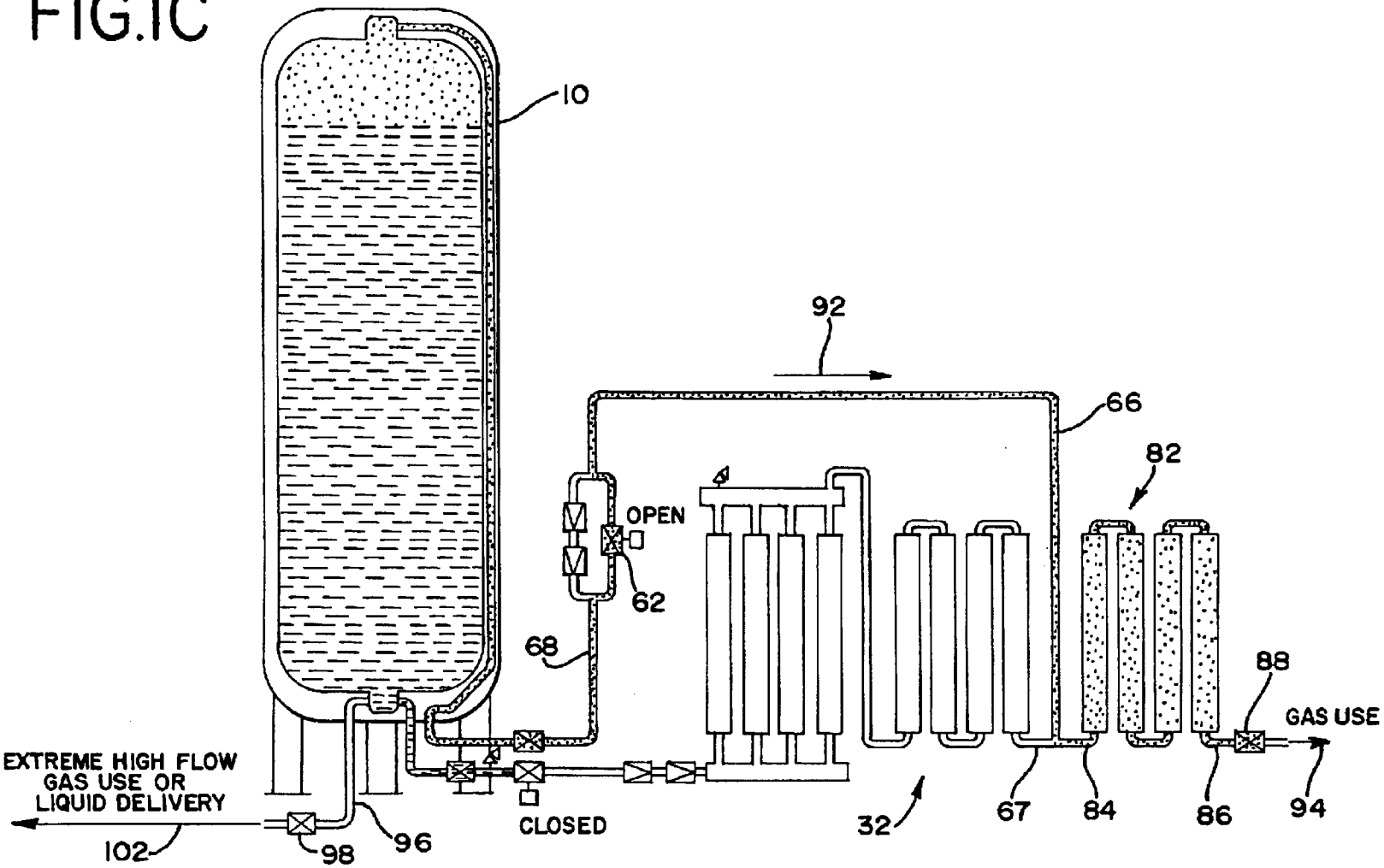
FIG.IC

HIGH FLOW PRESSURIZED CRYOGENIC FLUID DISPENSING SYSTEM

CLAIM OF PRIORITY

This application claims priority from U.S. Provisional Patent Application Ser. No. 60/334,192, filed Nov. 29, 2001, and currently pending.

BACKGROUND OF THE INVENTION

The present invention relates generally to systems for dispensing cryogenic fluids from vessels storing cryogenic liquids and, more particularly, to a dispensing system for cryogenic liquid bulk vessels that provides cryogenic fluids at high pressures and high flow rates.

Cryogenic gases are used in a variety of industrial and medical applications. Many of these applications require that the cryogen be supplied as a high pressure gas. For example, high pressure nitrogen and argon gases are required for laser welding while high pressure nitrogen, oxygen and argon gases are required for laser cutting. Gas pressure and flow rate requirements for industrial lasers in the range of approximately 400–420 psig and approximately 1500–2500 scfh, respectively, are now typical. Cryogens such as nitrogen, argon and oxygen are typically stored as liquids in vessels, however, because one volume of liquid produces many volumes of gas (600–900 volumes of gas per one volume of liquid) when the liquid is permitted to vaporize/boil and warm to ambient temperature. To store an equivalent amount of gas requires that the gas be stored at very high pressure. This would require heavier and larger tanks and expensive pumps or compressors.

Advances in industrial laser technologies have increased the flow requirements for cutting assist gases that exceed the capability of prior art cryogenic storage vessels and their associated pressure building systems. Specifically, the pressure building capabilities of prior art systems limit the flow of pressurized gas available for such applications.

Prior art vessel pressure building systems were designed with the philosophy that pressure building gas delivered to the head space of a vessel should be at the same temperature as the liquid cryogen in the vessel so as to avoid undesirable warming of the liquid cryogen. As such, prior art pressure building systems typically simply change the state of liquid cryogen from the vessel to vapor and direct the vapor to the head space of the vessel without adding any additional heat beyond that required for vaporization. In addition, traditional fluid flow thought would suggest that the pressure building process would be impaired if the flow were directed through traps in the flow path.

Experiments have shown, however, that a significant stratification of the inner vessel vapor or head space exists when warmed gas or vapor is introduced thereto. In addition, experiments have shown that further expanding the pressure building gas or vapor by adding more heat prior to delivering it to the head space of the vessel significantly increases the pressure building performance of the system. Prior art systems have failed to take advantage of these discoveries.

Accordingly, it is an object of the present invention to provide a high flow pressurized cryogenic fluid dispensing system that builds pressure very rapidly.

It is another object of the present invention to provide a high flow pressurized cryogenic fluid dispensing system that maintains pressure during dispensing at a variety of liquid temperatures.

It is another object of the present invention to provide a high flow pressurized cryogenic fluid dispensing system that provides a flow rating that is sufficient to supply cryogenic gas to multiple lasers.

It is another object of the present invention to provide a high flow pressurized cryogenic fluid dispensing system with pressure building that cycles on and off so that the heating/pressure building coils of the system at least partially thaw between cycles.

It is still another object of the present invention to provide a high flow pressurized cryogenic fluid dispensing system that reduces or eliminates safety vent losses.

It is still another object of the present invention to provide a high flow pressurized cryogenic fluid dispensing system that is economical to construct and maintain and that is durable.

Other objects and advantages will be apparent from the remaining portion of this specification.

SUMMARY OF THE INVENTION

The present invention is directed to a system for dispensing pressurized cryogenic fluids at high flow rates. The system of the present invention features a pressure building capability that is improved over the prior art, and thus offers a higher maximum flow capability. The system features a pressure building coil that includes a section of parallel heat exchangers and a section of series heat exchangers that are in communication with one another. An automatic pressure building regulator valve, when opened, permits cryogenic liquid from the system tank to enter the pressure building coil. Liquid entering the section of parallel heat exchangers flashes so that gas is produced. Surge check valves direct the gas into the section of series heat exchangers where it is warmed and pressurized. The warmed and pressurized gas is directed to the head space of the tank through a pair of flapper check valves so that the tank is rapidly pressurized. A controller opens the pressure building regulator valve and closes the vapor space withdrawal control valve when the pressure within the tank drops below the operating pressure/set point of the system.

Due to the improved pressure building, the gas use circuit of the system, which leads from the head space of the tank or the outlet of the pressure building coil through a warming coil to the use device or point, simply warms gas instead of vaporizing liquid from the tank. This reduces the number and size of heat exchangers required in the gas use circuit.

The system may optionally be constructed with a turbo circuit featuring a turbo line leading from the parallel section header to a venturi mixer positioned in the gas/vapor line leading to the warming coil. A turbo control valve is positioned in the turbo line. When the turbo valve is open, liquid from the parallel section header is injected into the gas flowing to the warming coil and is vaporized so that a greater gas flow rate is provided by the system. The turbo circuit therefore increases the flow rate capability of the system without additional heat exchangers. The turbo circuit thus increases the flexibility of the system.

The system may also be equipped with a rattle valve that receives exhausted pressurized air from the automatic valve control system. The rattle valve is positioned upon the section of parallel heat exchangers and vibrates so that ice is removed therefrom.

The following detailed description of embodiments of the invention, taken in conjunction with the accompanying drawings, provide a more complete understanding of the nature and scope of the invention.

BRIEF DESCRIPTION OF THE DRAWINGS

FIG. 1B is a schematic view of the system of FIG. 1A after the system set point and tank operating pressure have been reached;

FIG. 1C is a schematic view of the system of FIG. 1A with the tank at operating pressure and during gas dispensing;

DESCRIPTION OF THE PREFERRED EMBODIMENTS

Figure 1A:
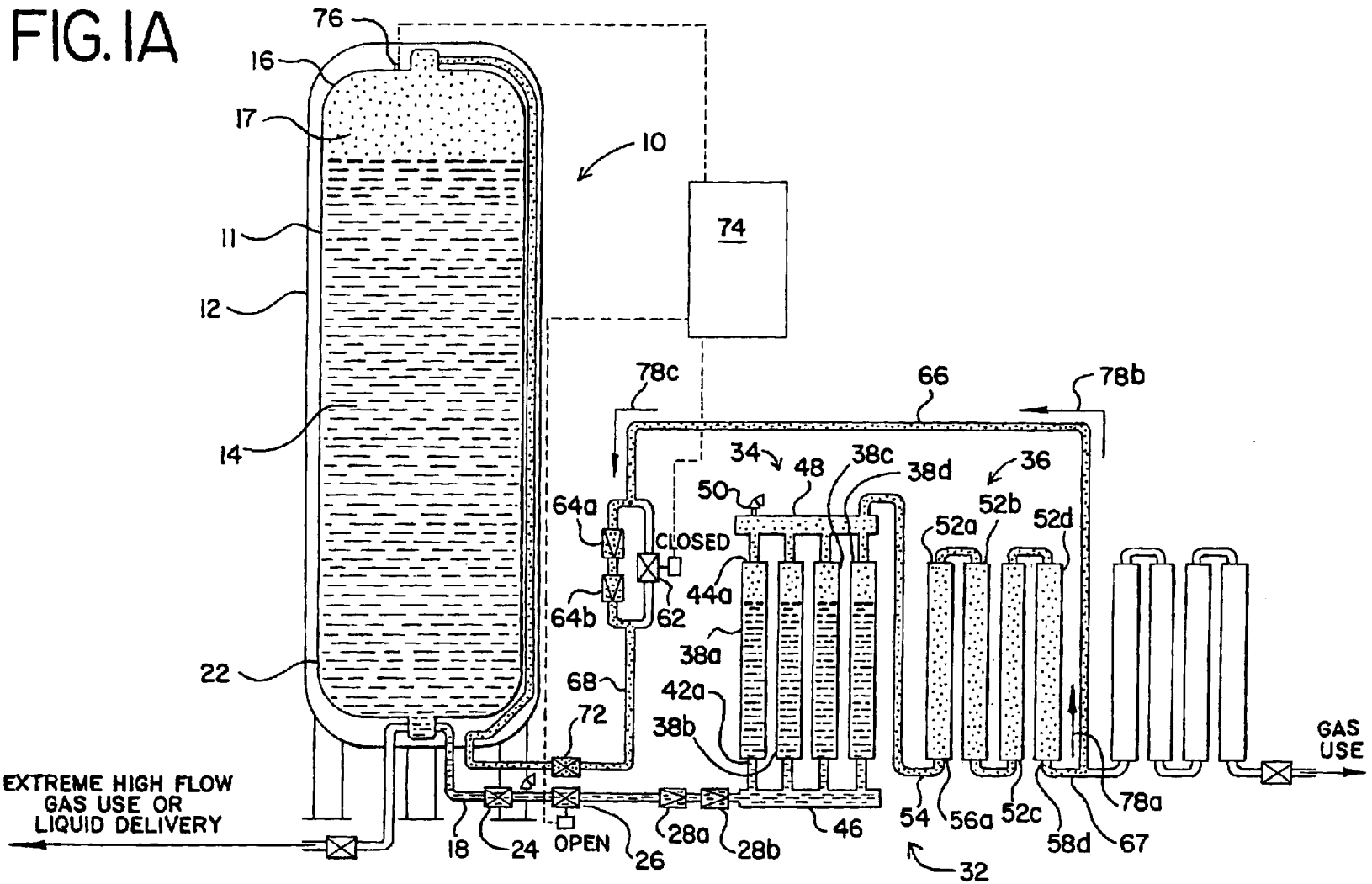
FIG. 1A is a schematic view of an embodiment of the high flow pressurized cryogenic fluid dispensing system of the present invention during pressure building without gas or liquid dispensing.

An embodiment of the system of the present invention is illustrated in FIG. 1A. A cryogenic liquid storage vessel or tank, indicated in general at 10, includes an inner tank 11 and outer jacket 12. The inner tank is partially filled with cryogenic liquid 14, such as liquid nitrogen or argon. A head space 16 above the liquid and contains cryogenic gas or vapor 17.

A liquid feed line 18 communicates with the liquid side 22 of the inner tank 11 and leads to a pressure building (PB) feed valve 24, an automated pressure building (PB) regulator valve 26, a pair of surge check (flapper) valves 28*a* and 28*b* and a pressure building coil, indicated in general at 32. The redundant check valves are provided to protect against blow-by from the pressure building coil to the liquid side of the tank. Pressure building coil 32 includes a section of parallel heat exchangers, indicated in general at 34, and a section of series heat exchangers, indicated in general at 36. It is to be understood that the number of heat exchangers illustrated in each section are examples only and that the actual number of heat exchangers may be varied.

The section of parallel heat exchangers 34 includes heat exchangers 38*a*–38*d*, each of which, as illustrated for heat exchanger 38*a*, includes an inlet 42*a* and an outlet 44*a*. The inlets of the parallel heat exchangers 38*a*–38*d* communicate with a parallel section liquid header 46, which receives liquid from the bottom of tank 10 passing through check valves 28*a* and 28*b*. The outlets of the parallel heat exchangers 38*a*–38*d* communicate with a parallel section vapor header 48. Parallel section vapor header 48 features pressure building circuit safety valve 50. The parallel section liquid and vapor headers each preferably feature an enlarged, cylindrical configuration (for example, three inches in diameter and three feet in length).

The section of series heat exchangers 36 includes heat exchangers 52*a*–52*d* that communicate with the parallel section vapor header 48 via line 54 and the inlet 56*a* of the first series heat exchanger 52*a*. The outlet 58*d* of the last heat exchanger 52 of the series section 36 communicates with an automated vapor space withdrawal control valve 62 having by-pass flapper check valves 64*a* and 64*b* via line 66 and pressure building coil outlet 67. The outlets of the vapor space withdrawal control valve 62 and by-pass flapper check valves 64*a* and 64*b* communicate with head space 16 of the tank 10 via line 68. A portion of line 68 travels through the space between the inner tank 11 and outer jacket 12 of tank 10.

Line 68 is equipped with a pressure building return isolation valve 72. As a result, the pressure building coil and associated circuit may be totally isolated from the tank 10 by closing valves 24 and 72. This is useful, for example, if the pressure building coil and associated circuit require repair or maintenance. PB feed valve 24 and pressure building return isolation valve 72 normally feature open configurations.

A controller 74 monitors the pressure within tank 10 via pressure sensor 76. The controller configures the PB regulating valve 26 and the automated vapor space withdrawal control valve 62 based upon the pressure within the tank 10. More specifically, the controller 74 features a set point that is generally equal to the lower limit of the operating pressure range of the system. When the pressure within the tank is below the set point, as illustrated in FIG. 1A, valve 26 is opened and valve 62 is closed. As will be explained in greater detail below, when the pressure within the tank rises above the set point, the PB regulating valve 26 is automatically closed and the automated vapor space withdrawal control valve 62 is automatically opened. Controller 74 may be a microcomputer or any other component (either electrical or mechanical/hydraulic) known in the art for controlling automatic valves.

After being refilled with liquid cryogen, the tank 10 must be pressurized to operating pressure, typically in the range of 300 psi to 450 psi. The pressure within tank 10 after refilling is typically around 150 psi to 200 psi. Pressurization is accomplished, as illustrated in FIG. 1A, by first opening PB feed valve 24. Given that the pressure within the tank 10 is below the system set point, the PB regulating valve 26 is opened while the automated vapor space withdrawal control valve 62 is closed.

With both valves 24 and 26 open, cryogenic liquid flows from the bottom of tank 10, through line 18 and valves 24, 26, 28*a* and 28*b* and into the parallel section liquid header 46. Liquid from the header 46 flows into the parallel heat exchangers 38*a*–38*d* where it flashes into gas. The surge check valves 28*a* and 28*b* direct the gas flow out of the parallel section 34 through vapor header 48 so that the gas travels to the series section 36 through line 54. The parallel section liquid and vapor headers promotes the surge and pumping action that occurs due to the flashing along with even flow through the parallel section. As the gas travels through the series heat exchangers 52*a*–52*d*, it is further heated and pressurized. The gas then flows through line 66, as indicated by arrows 78*a*, 78*b* and 78*c*, flapper check valves 64*a* and 64*b*, open PB return valve 72 and to the head space 16 of the tank 10 through line 68.

As a result, the tank 10 is pressurized very rapidly—the typical rate of pressure rise is 100 to 150 psi per minute when the tank is nearly full of liquid. This permits the tank to be pressurized to operating pressures in approximately three to five minutes. As an example only, the gas exiting the pressure building coil 32 and entering the tank head space 16 may be at a temperature between approximately −100° F. and −50° F. and a pressure of around 350 psi.

The section of parallel heat exchangers 34 preferably is designed and sized to merely add enough heat to change the entering cryogen from the liquid state to the gas or vapor state. The section of series heat exchangers 36 preferably is designed and sized to merely heat and pressurize the gas or vapor leaving the section of parallel heat exchangers. In other words, all vaporization preferably is done in the section of parallel heat exchangers. Both objectives may be accomplished by selecting the appropriate number and size of fins on the parallel and series heat exchangers.

As illustrated in FIG. 1B, when the pressure within tank 10 reaches the operating pressure, and thus the system set point is reached, the PB regulating valve 26 is automatically closed and the vapor space withdrawal control valve 62 is automatically opened by the controller 74 of FIG. 1A. The liquid remaining in the pressure building coil 32 vaporizes and the resulting gas, along with the remaining gas in the pressure building coil, flows to the head space of the tank through lines 66 and 68.

The system of the present invention thus provides a flow of warm gas to the head space of the vessel to provide rapid pressure building. This goes against prior art systems, methods and practices in that, prior to the present invention, it was believed that pressure building gas introduced to a head space should be at the same temperature as the cryogenic liquid below. It was believed that the addition of warmer cryogen into the tank was inefficient. As such, prior art pressure building systems provide only enough heat to simply change the state of cryogen used for pressure building from a liquid to a gas. No additional heat to warm and reduce the density of the gas is provided.

The system of the present invention, however, provides a significant stratification of the head space of the inner tank. More specifically, the warmed gas from the pressure building coil (the parallel and series heat exchanger sections) remains near the top of head space while the coolest gas drops to the surface of the liquid. Furthermore, the warmest liquid rises towards the surface of the liquid stored in the inner tank. The coolest liquid drops to the bottom of the inner tank. As a result, the portions of the gas and liquid within the vessel that are closest to one another in temperature are positioned adjacent to one another. This minimizes the heat transfer between the head space and liquid so that a region of minimal heat transfer or a "thermo liquid barrier" is formed adjacent to the liquid surface.

In effect, inner tank is divided into two sub-tanks by the thermo liquid barrier, one tank containing liquid while the other contains gas, with very little heat transfer between the two sub-tanks. The thermo liquid barrier thus allows the vessel to be pressurized with warm gas without significant penalties in terms of warming the liquid within the vessel. This minimizes, or eliminates altogether, the necessity of using an economizer regulator to control the pressure within the inner tank.

Because the portion of the liquid near the head space/gas is warmer than the remaining liquid in tank, when the liquid level within the tank drops to a low level, warm liquid travels into the pressure building coil. This improves the pressure building performance of the pressure building coil which, as a result, is capable of adequately pressurizing the enlarged head space in the tank.

As illustrated in FIG. 1C, a warming coil, indicated in general at 82, features an inlet 84 and communicates with the outlet 67 of the pressure building coil 32 and line 66. The outlet of the warming coil 82 also features an outlet 86 that is equipped with a gas dispensing valve 88. When the gas dispensing valve 88 is opened, and the pressure in the tank 10 is at operating pressure, that is, above the set point of the controller 74 (FIG. 1A), gas from the head space of the tank travels through line 68, open valve 62 and line 66, as indicated by arrow 92, to the warming coil 82. The gas is warmed and pressurized as it passes through the warming coil 82. As a result, high pressure gas is dispensed through the warming coil outlet 86 and dispensing valve 88, as indicated by arrow 94. As an example only, the gas may be dispensed at rates of approximately 5,000–12,500 scfh at a temperature of approximately 40° F. below ambient and a pressure of approximately 440 psig.

The absence of cryogen in the parallel and series sections of the pressure building coil 32 during the "economize mode" of operation described above allows them to warm and thaw. This reduces ice buildup on the pressure coil that would otherwise adversely effect its warming and pressure building performance.

Pressurized cryogenic liquid may be dispensed from the bottom of the tank 10 through liquid outlet line 96 when liquid use valve 98 is opened, as indicated by arrow 102. This liquid may be vaporized and further pressurized for extreme high flow gas use or used in high pressure liquid form.

Figure 1D:
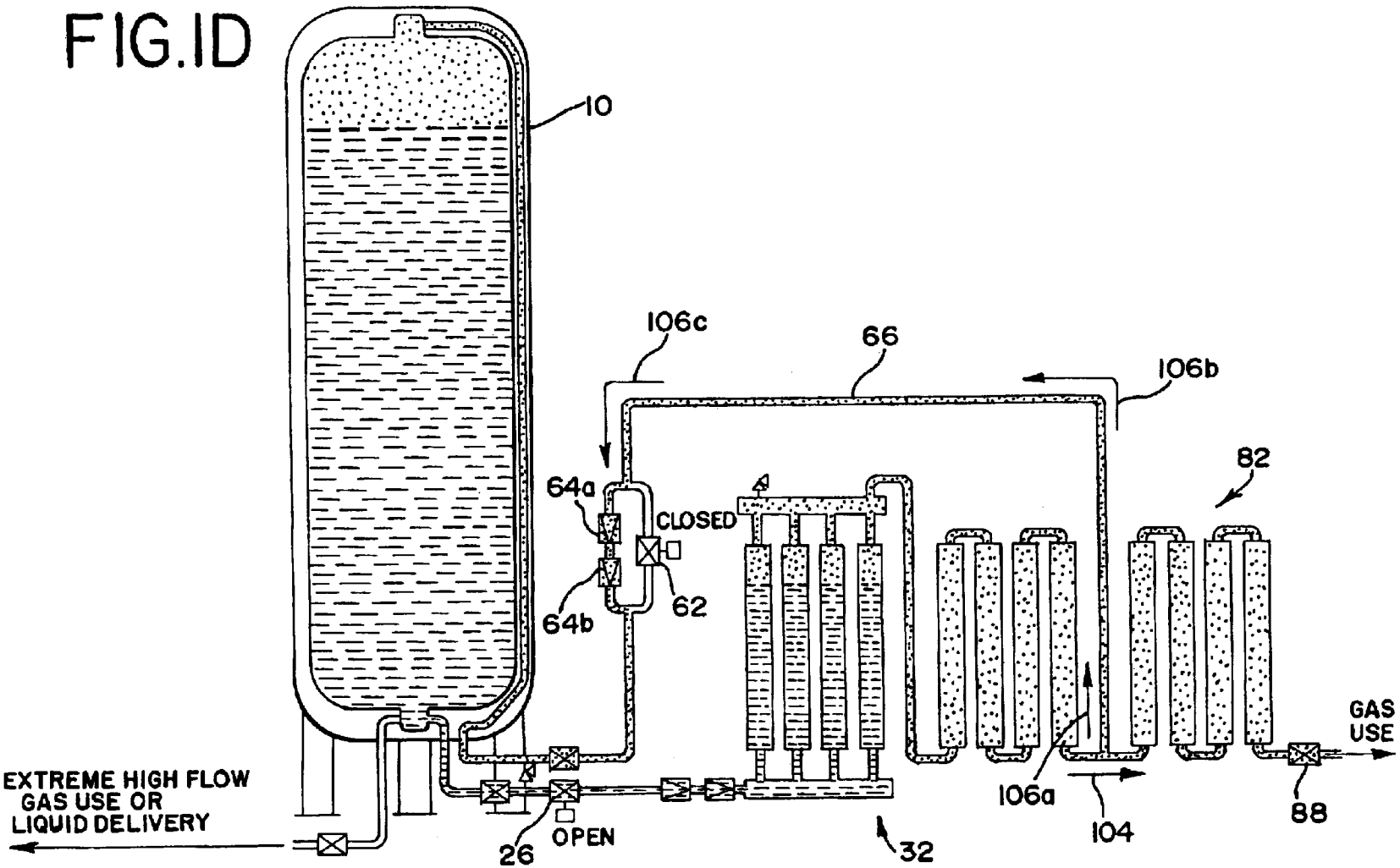
FIG. 1D is a schematic view of the system of FIG. 1A during pressure building and gas dispensing.

As gas dispensing proceeds through warming coil 82 and gas use valve 88, as illustrated in FIG. 1D, the PB regulating valve 26 opens and vapor space withdrawal control valve 62 automatically closes when the pressure within the tank 10 drops below the operating pressure, that is, when the system set point is encountered by the system controller (FIG. 1A). As a result of the reconfiguration of valves 26 and 62, liquid once again travels from the tank to the pressure building coil 32 so that gas is produced. As illustrated by arrow 104, a portion of this gas travels out through warming coil 82 so that gas dispensing may continue. The remaining gas, as illustrated by arrows 106*a*, 106*b* and 106*c*, travels to the head space of the tank 10 via line 66, through flapper check valves 64*a* and 64*b* and line 68, so that the tank may be re-pressurized to operating pressure.

As such, during normal gas use from the system, the pressure building will cycle on and off to compensate for the resulting pressure drops. In addition to numerous other advantages, the greater pressure building speed and efficiency of the system of the present invention allows higher flow rates to be achieved.

Figure 1E:
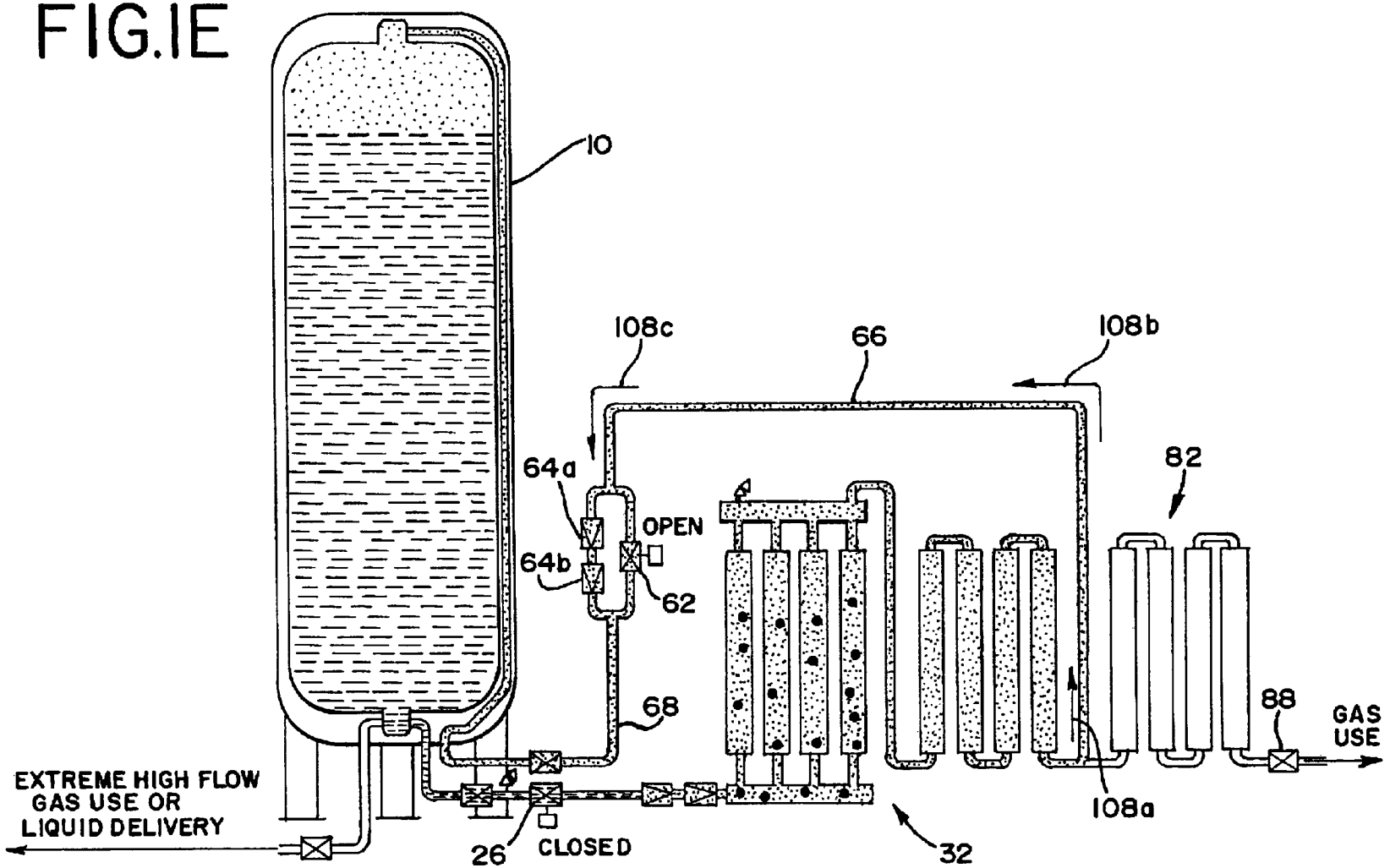
FIG. 1E is a schematic view of the system of FIG. 1A after gas dispensing has stopped and with the tank at operating pressure.

The situation where gas use has stopped is illustrated in FIG. 1E. Gas dispensing valve 88 has been closed so that no gas is passing through warming coil 82. If the pressure in tank 10 is below the operating pressure (below the set point for controller 74 of FIG. 1A), pressure building will continue as illustrated in FIG. 1A until the set point is reached. If the pressure in tank 10 is at the operating pressure (above the set point for controller 74 of FIG. 1A), as in FIG. 1E, PB regulating valve 26 will close and vapor space withdrawal control valve 62 will open. The liquid remaining in the pressure building coil 32 will vaporize and the resulting gas, along with the gas remaining in the pressure building coil, will flow to the head space of the tank 10 through line 66, open valve 62, valves 64*a* and 64*b* and line 68, as indicated by arrows 108*a*–108*c*. This may cause the pressure in the tank to rise above the operating pressure, however, the tank pressure should not reach the setting of the relief valve of the tank.

Figure 2:
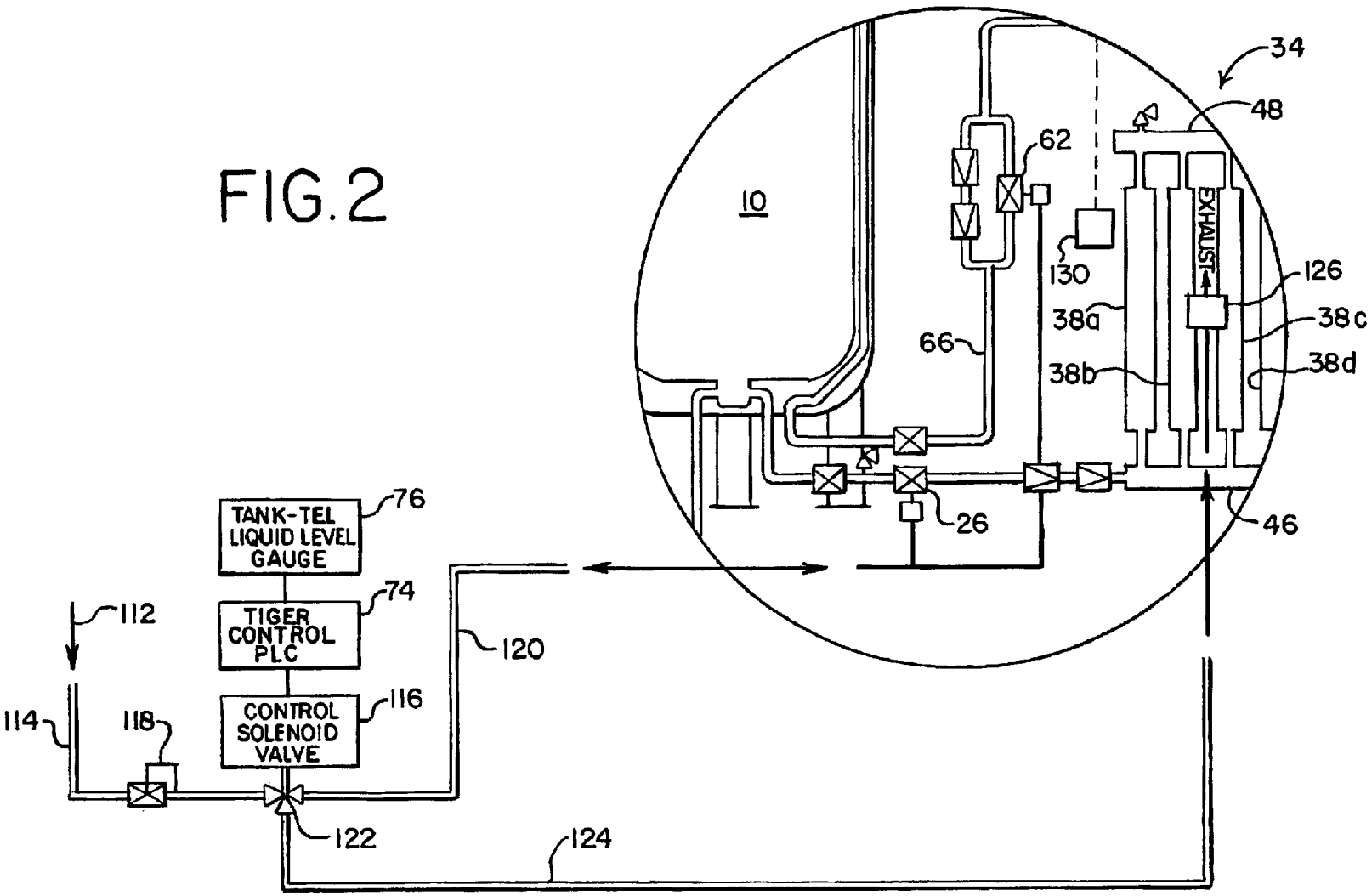
FIG. 2 is a schematic view of the automatic valve control portion of the system of FIG. 1A and an optional rattle valve feature.

The control system for automatic valves 26 and 62 is illustrated in greater detail in FIG. 2. Pressurized air 112 is provided via line 114 to a solenoid control valve 116. The pressurized air may be provided from a number of sources, including the head space of a bulk cryogenic storage tank (not shown). The line 114 is equipped with a regulator 118. The PB regulating valve 26 is normally in the closed configuration. Conversely, the vapor space withdrawal control valve is normally in the open configuration. When pressurized air is provided to each, they open and close, respectively. The controller 74 manipulates control solenoid valve 116 to direct the pressurized air to valves 26 and 62 via line 120 when the pressure within the tank drops below operating pressure (when the set point of controller 74 is reached), as detected by pressure sensor 76. As a result, the valves 26 and 62 are properly configured to pressurize the tank, as illustrated in FIGS. 1A and 1D.

The control solenoid valve 116 features an exhaust port 122. When the controller 74 stops the flow of pressurized air to valves 26 and 62, so that they are once again in the closed and open configurations, respectively, air in line 120 must be exhausted. This is done through the exhaust port 122 and line 124. Line 124 directs the exhaust gas to a rattle valve 126 that is mounted to the section of parallel heat exchangers 34. As the exhaust gas travels through the rattle valve 126, the section of parallel heat exchangers is shook so that ice is cleared from the heat exchangers 38*a*–38*d*. A second rattle valve may also be attached to the section of series heat exchangers (36 in FIG. 1A). Such rattle valves are well known in the art.

In addition to rattle valve 126, an electric heater 130, positioned in the vicinity of the section of parallel heat exchangers 34, may be added to prevent ice buildup on the heat exchangers 38*a*–38*d*. A second heater may also be positioned adjacent to the section of series heat exchangers (36 in FIG. 1A).

The above two ice management approaches (rattle valve and electric heater) may either one or both be required in very cold climates, such as the Northern United States, to prevent ice buildup on the pressure building coil.

Figure 3:
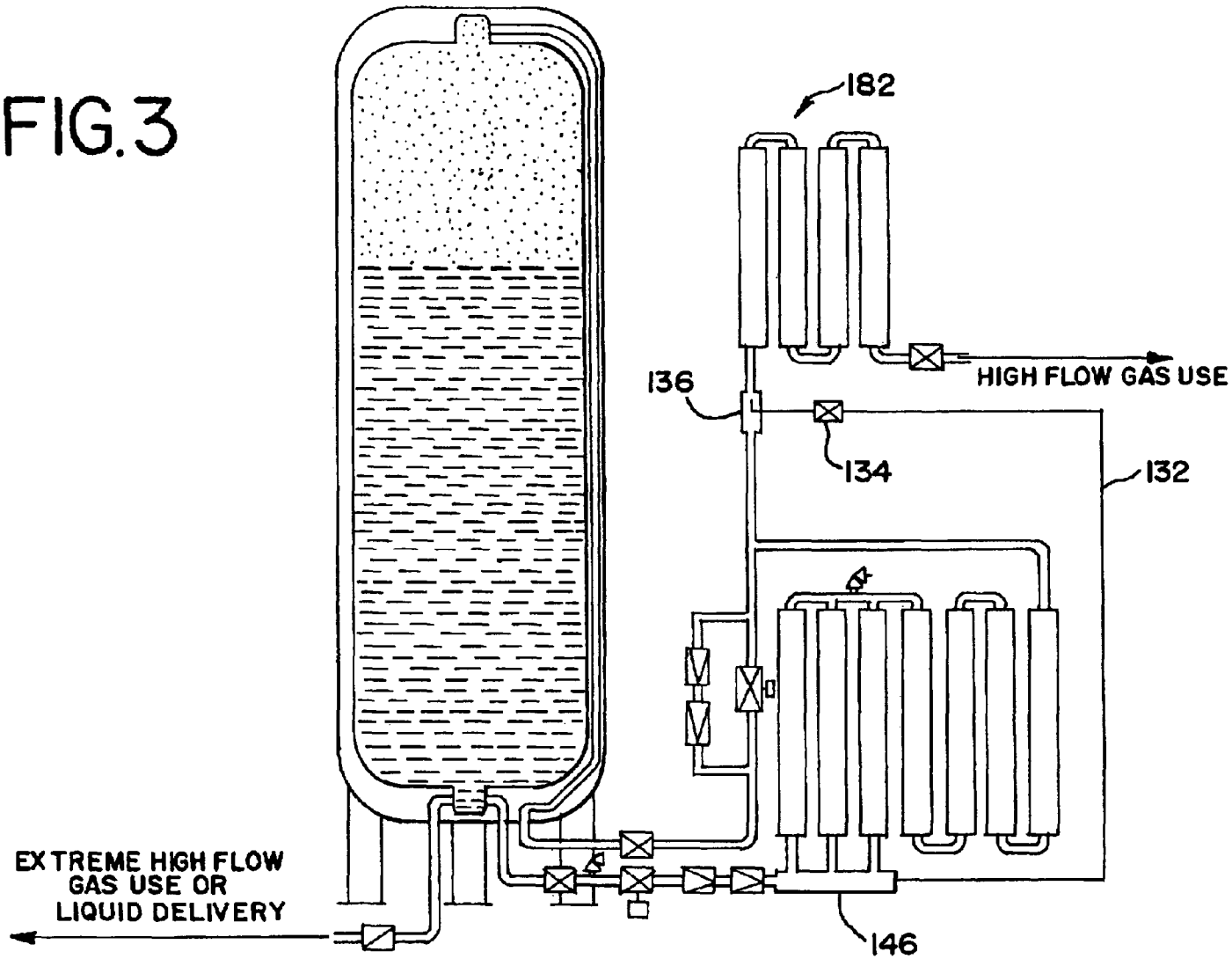
FIG. 3 is a schematic view of a second embodiment of the high flow pressurized cryogenic fluid dispensing system of the present invention wherein a turbo circuit is provided.

FIG. 3 illustrates a second embodiment of the system of the present invention. The system of FIG. 3 is similar to that of FIGS. 1A–1E with the exception of a turbo circuit consisting of turbo line 132 that is connected to parallel section liquid header 146, turbo control valve 134 and venturi mixer 136. The turbo circuit allows the system to dispense gas at a higher pressure without adding additional heat exchangers to the system. As a result, the turbo circuit provides the system with greater flexibility. Indeed, the system may provide gas to more than one industrial laser simultaneously due to its high flow rate and pressure building capabilities.

The turbo circuit provides additional gas when the turbo control valve 134 is opened. For example, the system may normally provide pressurized gas at 5,000 scfh, but may provide 10,000 scfh when the turbo control valve 134 is opened. When valve 134 is opened, liquid from the parallel section header flows through turbo line 132 due to the drawing/vacuum action of the venturi mixer 136. The liquid entering the venturi mixer 136 is vaporized and the resulting gas joins the stream entering the gas warming coil, indicated in general at 182. It should be noted that turbo valve 134 may be a simple hand valve or, alternatively, a regulator that automatically opens when higher demands are placed on the system by the use device.

Figure 4:
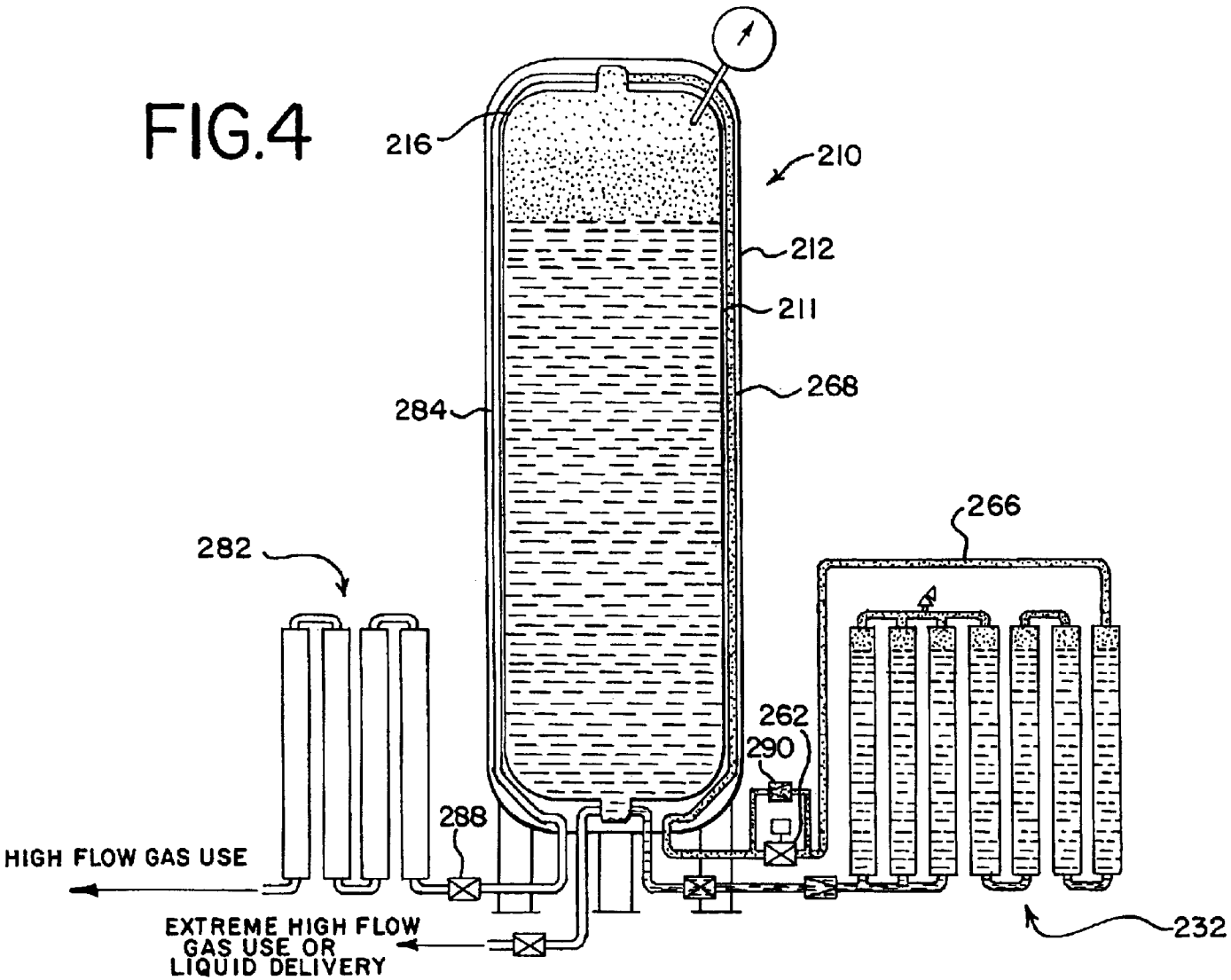
FIG. 4 is a schematic view of a third embodiment of the high flow pressurized cryogenic fluid dispensing system of the present invention.

FIG. 4 illustrates a third embodiment of the system of the present invention. The embodiment of FIG. 4 is similar to the embodiment of FIGS. 1A–1E with the exception that the warming coil 282 is connected directly to the head space 216 of tank 210 via gas feed line 284. Like line 268, line 284 passes through the space between the tank outer jacket 212 and inner tank 211. The system of FIG. 4, includes a PB regulating valve 262, which preferably is automated. While illustrated after the pressure building coil 232 in FIG. 4, PB regulating valve 262 could alternatively be placed in front of or upstream of the pressure building coil. During pressure building, valve 262 is open. As a result, cryogenic liquid from tank 210 travels into the pressure building coil 232 where it is vaporized and the resulting gas warmed. The gas is then provided to the head space 216 of tank 210 via line 268 so that the tank is rapidly pressurized.

Gas use valve 288 is opened when the system must dispense gas. When gas use valve 288 is opened, gas from the headspace of the tank travels through line 284 to the warming coil 282 where it is warmed and pressurized and then ultimately dispensed.

When the tank 210 reaches operating pressure, a system controller automatically closes valve 262 so that pressure building stops. The pressure building circuit includes a pressure building circuit by-pass spring check valve 290 that is set to open when the pressure in the pressure building coil 232 and the remainder of the pressure building circuit rises approximately 5 psi over the pressure in the tank 210. This is known as the "cracking pressure" and prevents the pressure building coil from becoming over-pressurized.

The system of FIG. 4 is unable to dispense gas at a rate above the continuous flow rating of the system. This is because if the continuous flow rating is exceeded, choking may occur which results in gas being withdrawn from the head space 216 of tank 210. As a result, the pressure head within tank 210 would collapse. This is in contrast to the system of FIGS. 1A–1E which permits intermittent flow rates above the continuous flow rating of the system.

It is to be understood that the number of heat exchangers illustrated in FIGS. 3 and 4 are examples only and the number of heat exchangers may vary depending upon system requirements and other factors.

While the preferred embodiments of the invention have been shown and described, it will be apparent to those skilled in the art that changes and modifications may be made therein without departing from the spirit of the invention.

What is claimed is:

1. A cryogenic fluid dispensing system comprising:

a) a tank containing a cryogenic liquid with a head space there above and having a liquid side;

b) a pressure building coil having an inlet in communication with the liquid side of the tank and an outlet in communication with the head space of the tank, said pressure building coil including a section of parallel heat exchangers and a section of series heat exchangers; and c) the pressure building coil receiving cryogenic liquid from the liquid side of the tank, vaporizing it, and providing a resulting gas to the head space of the tank so that the tank is pressurized.

2. The dispensing system of claim 1 further comprising a surge check valve in circuit between the liquid side of the tank and the inlet of the pressure building coil, said surge check valve permitting liquid to flow from the tank to the pressure building coil.

3. The dispensing system of claim 1 further comprising a warming coil, said warming coil selectively in communication with the outlet of the pressure building coil and receiving gas therefrom for dispensing.

4. The dispensing system of claim 1 further comprising a warming coil, said warming coil selectively in communication with the head space of the tank and receiving gas therefrom for dispensing.

5. The dispensing system of claim 1 wherein said section of parallel heat exchangers includes a parallel section liquid header in communication with inlets of a plurality of parallel heat exchangers, said parallel section liquid header in communication with the liquid side of the tank.

6. The dispensing system of claim 5 wherein said section of parallel heat exchangers also includes a parallel section vapor header in communication with the outlets of the plurality of parallel heat exchangers and the section of series heat exchangers.

7. The dispensing system of claim 1 further comprising a pressure building regulator valve in circuit between the liquid side of the tank and the pressure building coil.

8. The dispensing system of claim 7 wherein the pressure building regulator valve is automatic and further comprising a pressure sensor in communication with the head space of the tank and a controller in communication with the pressure sensor and the pressure building regulator valve, said controller opening the pressure building regulator valve when the pressure within the tank drops below a predetermined set point.

9. The dispensing system of claim 8 further comprising a rattle valve positioned on the pressure building coil and wherein the automatic pressure building valve is actuated by pressurized air and pressurized air exhausted from the pressure building valve is used to power the rattle valve so that ice is removed from the pressure building coil.

10. The dispensing system of claim 7 further comprising an vapor space withdrawal control valve in circuit between the pressure building coil and the head space of the tank.

11. The dispensing system of claim 10 wherein the pressure building regulator valve and the vapor space withdrawal control valve both are automatic and further comprising a pressure sensor in communication with the head space of the tank and a controller in communication with the pressure sensor and the pressure building regulator valve, said controller opening the pressure building regulator valve and closing the vapor space withdrawal control valve when the pressure within the tank drops below a predetermined set point.

12. The dispensing system of claim 11 further comprising a by-pass check valve in parallel with the vapor space withdrawal control valve.

13. The dispensing system of claim 1 further comprising a check valve in circuit between the pressure building coil and the head space of the tank.

14. The dispensing system of claim 1 further comprising a rattle valve positioned upon the pressure building coil, said rattle valve receiving pressurized air from a source and vibrating so as to remove ice from the pressure building coil.

15. The dispensing system of claim 12 wherein said rattle valve is positioned upon the section of parallel heat exchangers.

16. The dispensing system of claim 1 further comprising:

d) a check valve in circuit between the inlet of the pressure building coil and the liquid side of the tank so that a flow of liquid to the pressure building coil is permitted;

e) a warming coil, said warming coil in communication with the outlet of the pressure building coil and receiving gas therefrom for dispensing;

f) a venturi mixer in circuit between the pressure building coil and the warming coil;

g) a turbo line having an end positioned between the pressure building coil inlet and the check valve and another end in communication with the venturi mixer so that liquid from the section of parallel heat exchangers travels to the venturi mixer and is mixed with gas from the pressure building coil and vaporized for delivery to the warming coil.

17. The dispensing system of claim 16 wherein said section of parallel heat exchangers includes a parallel section liquid header in communication with inlets of a plurality of parallel heat exchangers, said parallel section liquid header in communication with the turbo line.

18. The dispensing system of claim 16 further comprising a turbo control valve position within the turbo line.

19. A method of pressurizing a tank containing a cryogenic liquid including steps of:

a) providing a section of parallel heat exchangers;

b) providing a section of series heat exchangers;

c) directing liquid from the tank to the section of parallel heat exchangers;

d) vaporizing the liquid in the parallel section of heat exchangers so that a gas is produced;

e) warming and pressurizing the gas in the series of heat exchangers; and f) delivering the gas to the head space of the tank.

20. The method of claim 19 further comprising the steps of:

g) providing a warming coil;

h) warming the gas from the series of heat exchangers in the warming coil; and i) dispensing the warmed gas.

* * * * *